United States Patent [19]

Zanni

[11] 4,361,920

[45] Dec. 7, 1982

[54] COMBINED GAS LIGHTER-BOTTLE OPENER

[75] Inventor: Paolo Zanni, Florence, Italy

[73] Assignee: FIAP S.r.l., Bologna, Italy

[21] Appl. No.: 188,901

[22] Filed: Sep. 19, 1980

[30] Foreign Application Priority Data

Sep. 28, 1979 [IT] Italy ..... 4937/79[U]

[51] Int. Cl.[3] ..... B25F 1/00

[52] U.S. Cl. ..... 7/151

[58] Field of Search ..... 361/247, 253; 7/109, 7/151, 169, 170

[56] References Cited

U.S. PATENT DOCUMENTS

| | | | |
|---|---|---|---|
| 310,003 | 12/1884 | Welshans | 7/109 |
| 2,904,373 | 9/1959 | Dowdy et al. | 7/151X |
| 3,564,341 | 2/1971 | Nishiura | 361/247 |

*Primary Examiner*—James G. Smith

*Attorney, Agent, or Firm*—Browdy and Neimark

[57] ABSTRACT

Disclosed herein is a combination gas lighter, for example of the piezoelectric type, in which the end where the nozzle is located is shaped both to be hung up and to be utilized as a bottle opener. In a preferred form, the opposite end is shaped both to be hung up on a suitable hook and to be utilized as a bottle opener. In one particular embodiment, the body of the gas lighter, or a part thereof is, with the relevant nozzle and the bottle opener, made in one single body.

6 Claims, 5 Drawing Figures

COMBINED GAS LIGHTER-BOTTLE OPENER

BACKGROUND OF THE INVENTION

The invention relates to a combined gas lighter-bottle opener.

DESCRIPTION OF THE PRIOR ART

It is known that in order to hang up a gas lighter, it is necessary to provide in the body thereof a through hole, by means of which it is possible to hang the gas lighter on a suitable hook. Alternatively to the foregoing, a tooth or a suitable housing is provided in the nozzle, by means of which it is possible to hook the gas lighter on a mating plate fastened to a wall.

It is also known that the handles of the bottle openers to be found on the market are of a limited length, which causes the leverage to be somewhat short and problems derived therefrom to occur.

SUMMARY OF THE INVENTION

The object of the invention is to make available a combination so shaped as to carry out the functions of a gas lighter and a bottle opener.

Another object of the invention is to make available a combination that can be hooked, with great ease, to a suitable support, and is constructed in such a way as to offer considerable leverage when utilized as a bottle opener.

BRIEF DESCRIPTION OF THE DRAWINGS

The characteristics of the combination in question are illustrated, in a number of embodiments, in the accompanying drawings, in which.

DESCRIPTION OF THE PREFERRED EMBODIMENTS

Figure 1:
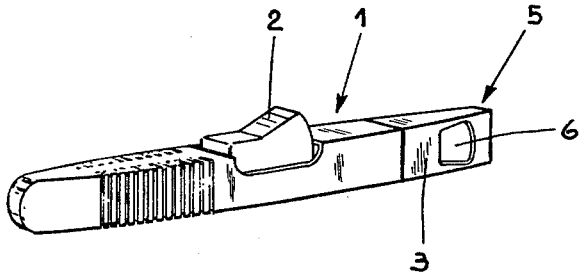
FIGS. 1 and 2 show, in a perspective view, the combination in a first embodiment, with the bottle opener fashioned directly in the nozzle.
Figure 2:
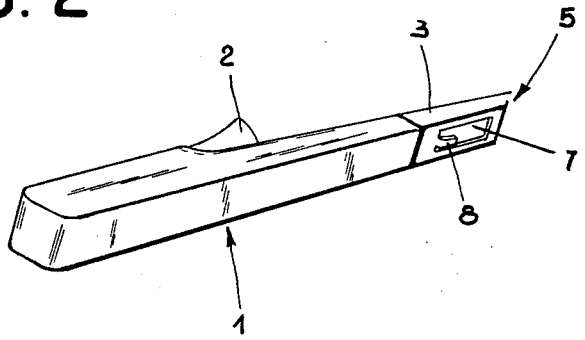

With reference to FIGS. 1 and 2, at (1) there is a gas lighter of the piezoelectric type, the pushbutton and the nozzle of which (containing the electrodes in between which the arc is struck) are shown at (2) and (3), respectively.

As can be seen from the said figures, the nozzle (3) in FIG. 1 has fashioned in it a slot (6) (directly during the forming of said nozzle) shaped in accordance with the dimensions of an ordinary bottle opener (5) for crown caps, while the nozzle (3) in FIG. 2 (illustrating another type of gas lighter with a narrower nozzle) has fashioned in it, an elongated slot (7) with a hook (8) at one extremity thereof, that extends beyond the lower plane of the nozzle and constitutes the hooking device for opening crown caps in accordance with a second typical solution for ordinary bottle openers (5).

The said hook (8) can also be fashioned contemporaneously with the operation of forming the nozzle (3).

Figure 3:
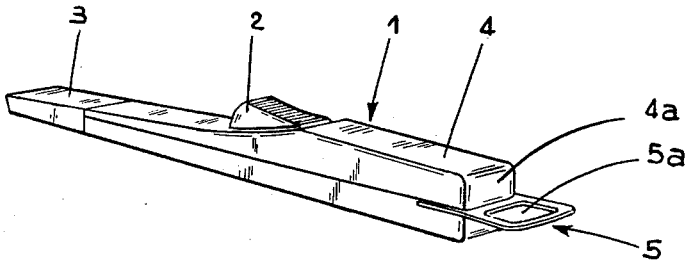
FIGS. 3 and 4 show, in a perspective view, the combination in a second embodiment, with the bottle opener placed in the region of the opposite extremity to the nozzle.

As illustrated in FIG. 3, to the gas lighter is fixed on the body (4) thereof, at the opposite extremity **(4*a*) to the nozzle, a bottle opener (5). The way in which the said fixing is achieved is such as to cause, with respect to the extremity (4*a*), only the active part (5*a*) of the said bottle opener (5)** to project.

Figure 4:
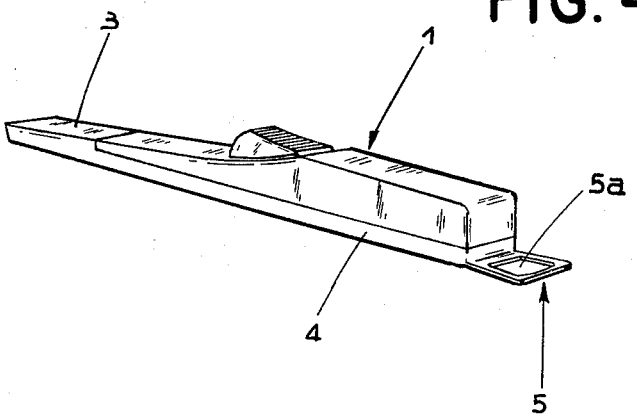

In a further embodiment according to FIG. 4, the lower part of the body (4), the nozzle (3) and the bottle opener (5) are made in one single body.

Figure 5:
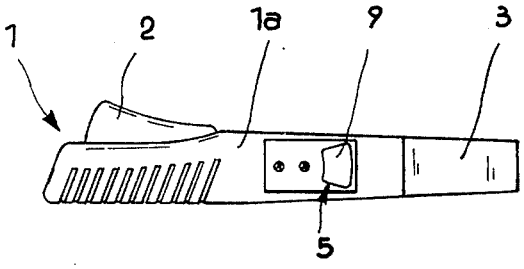
FIG. 5 shows, in a lateral view, the combination in a further embodiment, with the bottle opener placed in the region of a lateral wall in the body of the gas lighter.

In the last embodiment shown in FIG. 5, the bottle opener (5) is secured laterally to the body **(1*a*)** of the gas lighter in a way whereby it is nowhere near the nozzle thereof (thus retaining in full the technical characteristics and efficiency) and, at the same time, an article of a pleasing aspect is created.

In all the embodiments illustrated, the bottle opener (5) performs a dual function: the first being to remove crown caps fitted to hermetically sealed bottles and for this, the handle of the bottle opener is constituted by the body of the gas lighter, the length of which determines, in practice, the leverage length of the said bottle opener, which is certainly greater than that of the bottle openers on the market up until now. The second function is to allow the gas lighter to be hooked to a suitable (non-illustrated) support, by means of the slots **(5*a*), (6), (7) or (9)**.

The invention can also be manufactured in forms that differ from those described above, without deviating in any way from the framework of protection afforded to the invention as claimed below.

What is claimed is:

1. In combination, a gas lighter comprising gas lighter means mounted on an elongated body, bottle opener means mounted on said elongated body, and said gas lighter elongated body comprising handle means for said bottle opener means affording substantial leverage to a user using said bottle opener means.

2. The combination of claim 1, wherein said bottle opener means is provided at one end of said gas lighter elongated body.

3. The combination of claim 2, wherein said gas lighter means comprises a nozzle, and said gas lighter means nozzle and said bottle opener means being positioned together at one end of said gas lighter elongated body.

4. The combination on claim 3, wherein said nozzle, said bottle opener means, and the adjacent portion of said gas lighter body, are formed in a unitary manner.

5. The combination of claim 2, wherein said gas lighter means comprises a nozzle, and said gas lighter means nozzle and said bottle opener means are positioned at the two opposite ends of said gas lighter body.

6. The combination of claim 1, said gas lighter means comprising a nozzle positioned at one end of said elongated body, and said bottle opener means being mounted on said gas lighter means elongated body intermediate the ends thereof.

* * * * *